US005794667A

United States Patent [19]

Payne et al.

[11] Patent Number: 5,794,667

[45] Date of Patent: Aug. 18, 1998

[54] PRECISION FUEL DISPENSER

[75] Inventors: Edward A. Payne, Greensboro; Hal C. Hartsell, Jr., Kernersville; Walter L. Baker, Greensboro, all of N.C.

[73] Assignee: Gilbarco Inc., Greensboro, N.C.

[21] Appl. No.: 650,917

[22] Filed: May 17, 1996

[51] Int. Cl.[6] ..... B67D 5/08

[52] U.S. Cl. ..... 141/128; 141/1; 222/52; 222/71

[58] Field of Search ..... 141/59, 1, 128; 222/52, 63, 71

[56] References Cited

U.S. PATENT DOCUMENTS

| | | | |
|---|---|---|---|
| 3,386,620 | 6/1968 | Smith | 141/128 X |
| 3,536,109 | 10/1970 | Ginsburgh et al. | 141/98 |
| 3,586,070 | 6/1971 | Daniels, Jr. | 141/128 |
| 4,277,832 | 7/1981 | Wong | 364/510 |
| 4,345,146 | 8/1982 | Story et al. | 235/381 |
| 4,354,620 | 10/1982 | Tsuneda et al. | 222/14 |
| 4,360,127 | 11/1982 | Maruyama et al. | 222/14 |
| 4,410,109 | 10/1983 | Murrell, Jr. et al. | 222/52 |
| 4,572,405 | 2/1986 | Miura | 222/14 |
| 4,595,122 | 6/1986 | Yoshida et al. | 222/14 |
| 4,637,525 | 1/1987 | Miura et al. | 222/22 |
| 4,662,539 | 5/1987 | Komukai | 222/14 |
| 4,726,492 | 2/1988 | Komukai | 222/14 |
| 4,770,677 | 9/1988 | Harris | 55/168 |
| 4,876,653 | 10/1989 | McSpadden et al. | 364/479 |
| 4,877,146 | 10/1989 | Harris | 220/85 |
| 4,878,598 | 11/1989 | Ruschhaupt, Jr. | 222/1 |
| 4,919,305 | 4/1990 | Podgers | 222/55 |
| 4,930,665 | 6/1990 | Devine | 222/28 |
| 4,944,779 | 7/1990 | Szlaga et al. | 55/168 |
| 5,018,645 | 5/1991 | Zinsmeyer | 222/14 |
| 5,033,644 | 7/1991 | Tentler | 222/57 |
| 5,038,971 | 8/1991 | Gayer et al. | 222/1 |
| 5,053,774 | 10/1991 | Schuermann et al. | 342/44 |
| 5,086,403 | 2/1992 | Slocum et al. | 222/52 X |
| 5,125,533 | 6/1992 | Gayer et al. | 222/28 |
| 5,163,586 | 11/1992 | Zinsmeyer | 222/14 |
| 5,249,612 | 10/1993 | Parks et al. | 141/219 |
| 5,257,720 | 11/1993 | Wulc et al. | 222/20 |
| 5,431,302 | 7/1995 | Tulley et al. | 222/14 |
| 5,433,342 | 7/1995 | Luro | 222/1 |
| 5,509,434 | 4/1996 | Boyd et al. | 137/8 |

FOREIGN PATENT DOCUMENTS

| | | |
|---|---|---|
| 0 360 464 | 8/1989 | European Pat. Off. . |
| 37 18657A1 | 12/1988 | Germany . |
| 2 108 471A | 7/1982 | United Kingdom . |
| 2 253 338A | 1/1992 | United Kingdom . |

*Primary Examiner*—J. Casimer Jacyna
*Attorney, Agent, or Firm*—Rhodes Coats & Bennett, L.L.P.

[57] ABSTRACT

A fuel dispenser for delivering fuel along a fuel delivery path, a flow rate modulator in the fuel delivery path and a control system operatively associated with the flow rate modulator for regulating the rate of flow in the fuel delivery path during a fueling operation to achieve a flow-rate-dependent result. The precision fuel dispenser may further include a flow transducer in the fuel delivery path configured to provide a flow transducer signal representing a volume of fuel flow in the fuel delivery path to the control system.

37 Claims, 13 Drawing Sheets

PRECISION FUEL DISPENSER

BACKGROUND OF THE INVENTION

The present invention relates generally to fuel dispensers and, more particularly, to fuel dispensers for precisely delivering and controlling the rate of fuel flow to a vehicle or container during a fueling operation.

Federal regulations will limit vehicle fueling to ten gallons per minute (GPM) beginning in 1996 in order to achieve legislated limits on the amount of spillage from vehicle fueling operations. See 58 Federal Register 16019. Gasoline dispensers will be restricted to a maximum delivery rate of 10 GPM in an effort to reduce fuel spit-back and spillage and the resultant exposure of fuel to customers and the environment. The current technology for restricting fuel delivery rate on gasoline dispensers is to install restrictive orifices at accessible points in the delivery system and/or vary hose and nozzle configurations, otherwise known as hanging hardware, accordingly.

The accuracy of restricted orifices and hanging hardware inherently suffers from fluctuations in system feed pressure. System feed pressure is affected by a number of variables including the number of active fueling positions, clogged fuel filters, kinked hoses and other deteriorating components along a fuel delivery path. The requisite restriction is dependent upon site specifics, such as, but not limited to, pumping device capacity, pipe diameter, pipe length, head height, hose diameter, hose length and nozzle type. These factors prevent effective factory presetting of desired fuel delivery rates. Moreover, orifices and hardware are subject to tampering, removal or substitution in an effort to defeat flow restrictions. When fuel pumps incorporating the current technology are checked for compliance with the regulations, the testing authority will check the highest flow delivery hose, typically the hose closest to the main turbine pump, with all other hoses inactive. Once adjustments are made to limit the high-flow hose to 10 GPM, the lower flow hoses will inherently deliver less than 10 GPM. The situation is exacerbated when multiple pumps are active. Under these situations, even the highest flow hose will often deliver significantly less than 10 GPM.

Restrictive orifices and hanging hardware provide virtually no control over the fueling operation. Such hardware restricts flow rate at certain pressure levels. In other words, a 10 GPM restrictive orifice will allow fuel delivery at 10 GPM only under specific conditions. The fuel dispenser will deliver fuel at substantially less than 10 GPM a vast majority of the time, if not all of the time. Thus, with the current technology, the maximum delivery rate of 10 GPM will hardly ever be obtained, since a true optimization or average delivery rate cannot be controlled or calculated with presently existing fuel dispensers.

The current technology does not provide a way to optimize fuel delivery while abiding by the government regulations. Current fuel dispensers cannot maximize delivery rates and minimize spillage while maintaining an average fuel delivery rate of 10 GPM during a substantial portion of the fueling operation. Individual fuel dispensers are unable to optimize and control fueling in multi-dispenser systems. Additionally, the current technology cannot provide precise regulation of fuel delivery under varying dynamic changes affecting the fuel delivery rate by site, dispenser, user and other variables. For example, substantial changes in pressure within the fuel delivery system occur when other pumps within the system turn on or off, or adjust fueling rates. Currently, these changes in pressure prevent precise fueling regulation and optimization. Furthermore, current fuel dispensers are unable to adequately control delivery rate overshoot and undershoot or provide sufficient system response times. Without such control, precisely controlling a fueling operation is virtually impossible.

With the inability to precisely control and optimize the fueling operation, current dispensers are unable to precisely control the ramping up of the delivery rate to prevent the initial surge at the onset of fueling or the ramping down of the flow rate to quickly and efficiently reach pre-set sale values. Providing a fuel dispenser capable of precisely controlling the entire fueling operation would enable a very smooth, quick and efficient fueling operation. The applicant's invention provides this capability, which was previously unavailable.

A precisely controlled fueling operation provides greater environmental protection capability by minimizing fuel spillage and spit-back. By reducing the initial surge at the onset of fueling and ramping down the flow rate towards the end of fueling, the amount of fuel spilled is greatly reduced. Furthermore, precisely controlling the fuel delivery allows precise flow rate control dependent upon a number of predetermined cut-offs during a predetermined period of time. Rapid, successive cut-offs indicate splash-back or excessive turbulence in the nozzle's fill neck, a condition likely to lead to fuel spills. Fuel dispensers are currently unable to control the fueling operation to effectively react to scenarios leading to fuel spills. The applicant's invention provides such control to both minimize fuel spills and optimize fueling.

A further disadvantage of current fuel dispensers is the inability to automatically compensate for deteriorating components which nominally reduce flow. Components which often reduce flow include clogged fuel filters and kinked hoses. The applicant's invention allows fueling optimization even when the system components are not optimum. For example, as the fuel filter fills with debris, the flow control signal to the system fuel pump is increased in an amount to precisely compensate for any flow rate loss.

A further shortcoming of the current fuel dispenser technology is the inability for the system to signal when certain flow rates are no longer achievable. Such indications would alert the user or owner of a filter needing replacement, a hose deformation or some other condition obstructing the fuel passageway. The applicant's invention provides the ability to precisely monitor flow rate and provide a signal indicating when certain flow rates are unachievable due to various system conditions.

Thus, there remains a need for a new and improved fuel dispenser capable of optimizing fuel flow rate per regulatory agency mandate while maximizing site throughput under varying dynamic conditions. A need exists for a fuel dispenser capable of delivering fuel at precise flow rates independent of site variations and capable of being manufactured in a manner requiring no field modifications or calibrations. A further need exists for providing precise fuel delivery in a cost effective manner and providing for efficient modification of existing fuel dispensers. Furthermore, there remains a need for a fuel dispenser capable of delivering fuel to achieve a flow-rate-dependent result to optimize fueling while minimizing spillage. Additionally, there remains a need for a fuel dispenser capable of compensating for deteriorating components and providing information indicative of the fuel delivery path condition.

SUMMARY OF THE INVENTION

The present invention is directed to a precision fuel dispenser capable of precisely controlling the rate of fuel flow to a vehicle or container during a fueling operation.

Accordingly, one aspect of the present invention is to provide a fuel dispenser for delivering fuel along a fuel delivery path, a flow rate modulator in the fuel delivery path and a control system operatively associated with the flow rate modulator for regulating the rate of flow in the fuel delivery path during a fueling operation to achieve a flow-rate-dependent result. The precision fuel dispenser may further include a flow transducer in the fuel delivery path configured to provide a flow transducer signal representing a volume of fuel flow in the fuel delivery path to the control system.

The flow transducer signal may provide data to allow calculation of flow rate or may provide flow rate information directly. Furthermore, ascertaining the flow rate is important. The way the flow rate is determined will vary according to the specific application. Currently, pulsers are used to provide a volume signal from which flow rate is easily calculated. However, any way to measure flow rate is acceptable with or without actual volume measurements.

The dispenser's control system may derive a forcing function from differences between an actual flow rate determined from the flow transducer signal and a desired flow rate, the control system further regulates the rate of flow in the fuel delivery path according to the forcing function.

Another aspect of the present invention is to provide a precision fuel dispenser wherein the control system has a reference flow rate representing a desired flow rate. The control system regulates the rate of flow in the fuel delivery path to achieve the reference flow rate.

Another aspect of the present invention is to provide a precision fuel dispenser capable of optimizing the fueling operation to maximize fueling rates while minimizing fuel spillage. The dispenser control system may ramp up the rate of flow in the delivery path from a lower rate of flow to minimize initial fuel surge, which often leads to fuel spillage. The control system may ramp down the rate of flow in the delivery path from a higher rate of flow to reduce the chance of fuel spillage at the end of fueling.

Controlling the ramping up or down of the fueling rate also aids in fueling optimization and precise delivery control with little or no over- or undershoot of desired flow rates. The control system may control the rate of flow in the delivery path to provide a predetermined average rate of flow during a portion of the fueling operation. Such control allows fueling optimization and reduces fuel spillage.

In particular, regulatory mandates may be periodically exceeded while maintaining the regulated average. This provides a significant advantage with multiple dispenser systems which often fuel well under acceptable flow rates due to pressure losses associated with operating multiple pumps. Similarly, the control system may control the rate of flow in the delivery path to provide a predetermined average rate of flow during most of the fueling operation. The control system may control the rate of flow in the delivery path to provide a predetermined rate of flow under varying dynamic conditions. These conditions may include pressure changes and component failures or deterioration. Even under such diverse conditions, the invention can optimize fueling. Similarly, the control system may control the rate of flow in the delivery path to provide a predetermined average rate of flow under varying dynamic conditions. A related aspect of the control systems is to control the rate of flow in the delivery path to compensate for deteriorating components or obstructions which reduce flow.

The control system reduces fuel spillage and protects the environment by controlling the rate of flow in the delivery path to provide a reduced rate of flow after a premature automatic shut-off. Premature shut-offs indicate excessive turbulence in the fill neck which increases the risk of spilling fuel. Further protection from spillage is provided by controlling the rate of flow in the delivery path to assist in topping off a fueling operation, controlling the rate of flow in the delivery path to provide a reduced rate of flow when a predetermined number of automatic shut-offs occur, or controlling the rate of flow in the delivery path to provide a reduced rate of flow when a predetermined number of automatic shut-offs occur within a predetermined period of time.

Another aspect of the present invention is configuring the control system to indicate when a certain rate of flow is not achievable, when fuel flow is inhibited, when a filter needs replaced, when a delivery hose is deformed, or when the delivery path is otherwise obstructed. Providing such indications enables delivery and system diagnostics unobtainable in prior dispensers.

Another aspect of the present invention is to provide a precision fuel dispenser wherein the flow rate modulator includes a control valve.

Another aspect of the present invention is to provide a precision fuel dispenser wherein the flow rate transducer includes a flow meter and the transducer signals include volumetric pulses to the control system.

Another aspect of the present invention is to provide a method of delivering fuel including the steps of delivering fuel along a fuel delivery path, modulating fuel flow in the fuel delivery path, and controlling the modulating of fuel flow to regulate the rate of flow in the fuel delivery path during a fueling operation to achieve a flow-rate-dependent result. The method of delivering fuel may also include providing a flow signal representing a volume of fuel flow in the fuel delivery path. The method of delivering fuel may further include deriving a forcing function from differences between an actual flow rate determined from the flow signal and a desired flow rate, and regulating the rate of flow in the fuel delivery path according to the forcing function.

Another aspect of the present invention is to provide a method of delivering fuel including the step of providing a reference flow rate representing a desired flow rate and regulating the rate of flow in the fuel delivery path to achieve the reference flow rate.

Still another aspect of the present invention is to provide a method of delivering fuel capable of ramping up the rate of flow in the delivery path from a lower rate of flow to achieve a flow-rate-dependent result.

Another aspect of the present invention is to provide a method of delivering fuel capable of ramping down the rate of flow in the delivery path from a higher rate of flow to achieve a flow-rate-dependent result.

Another aspect of the present invention is to provide a method of delivering fuel capable of controlling the rate of flow in the delivery path to provide a predetermined average rate of flow during a portion of the fueling operation to achieve a flow-rate-dependent result.

Another aspect of the present invention is to provide a method of delivering fuel capable of controlling the rate of flow in the delivery path to provide a predetermined average rate of flow during most of the fueling operation to achieve a flow-rate-dependent result.

Another aspect of the present invention is to provide a method of delivering fuel capable of controlling the rate of flow in the delivery path to provide a predetermined rate of flow under varying dynamic conditions to achieve a flow-rate-dependent result.

Another aspect of the present invention is to provide a method of delivering fuel capable of controlling the rate of flow in the delivery path to provide a predetermined average rate of flow under varying dynamic conditions to achieve a flow-rate-dependent result.

Another aspect of the present invention is to provide a method of delivering fuel capable of controlling the rate of flow in the delivery path to provide a reduced rate of flow after a premature automatic shut-off.

Another aspect of the present invention is to provide a method of delivering fuel capable of controlling the rate of flow in the delivery path to assist in topping off a fueling operation.

Another aspect of the present invention is to provide a method of delivering fuel capable of controlling the rate of flow in the delivery path to provide a reduced rate of flow when a predetermined number of automatic shut-offs occur.

Another aspect of the present invention is to provide a method of delivering fuel-capable of controlling the rate of flow in the delivery path to provide a reduced rate of flow when a predetermined number of automatic shut-offs occur within a predetermined period of time.

Another aspect of the present invention is to provide a method of delivering fuel capable of controlling the rate of flow in the delivery path to compensate for deteriorating components which reduce flow.

Another aspect of the present invention is to provide a method of delivering fuel capable of indicating when a certain rate of flow is not achievable, when fuel flow is inhibited, when a filter needs replaced, when a delivery hose is deformed or when the delivery path is otherwise obstructed.

Yet another aspect of the present invention is to provide a method of controlling fuel flow along a fuel path including the steps of providing a desired flow rate for regulating the rate of flow in the fuel delivery path during a fueling operation, providing an actual flow rate, deriving a forcing function according to a difference between the desired and actual flow rate, modulating the flow of fuel in the fuel path according to the forcing function, and regulating the rate of flow in the fuel delivery path during a fueling operation to achieve a flow-rate-dependent result.

These and other aspects of the present invention will become apparent to those skilled in the art after a reading of the following description of the preferred embodiment when considered with the drawings.

DESCRIPTION OF THE PREFERRED EMBODIMENT

Figure 1:
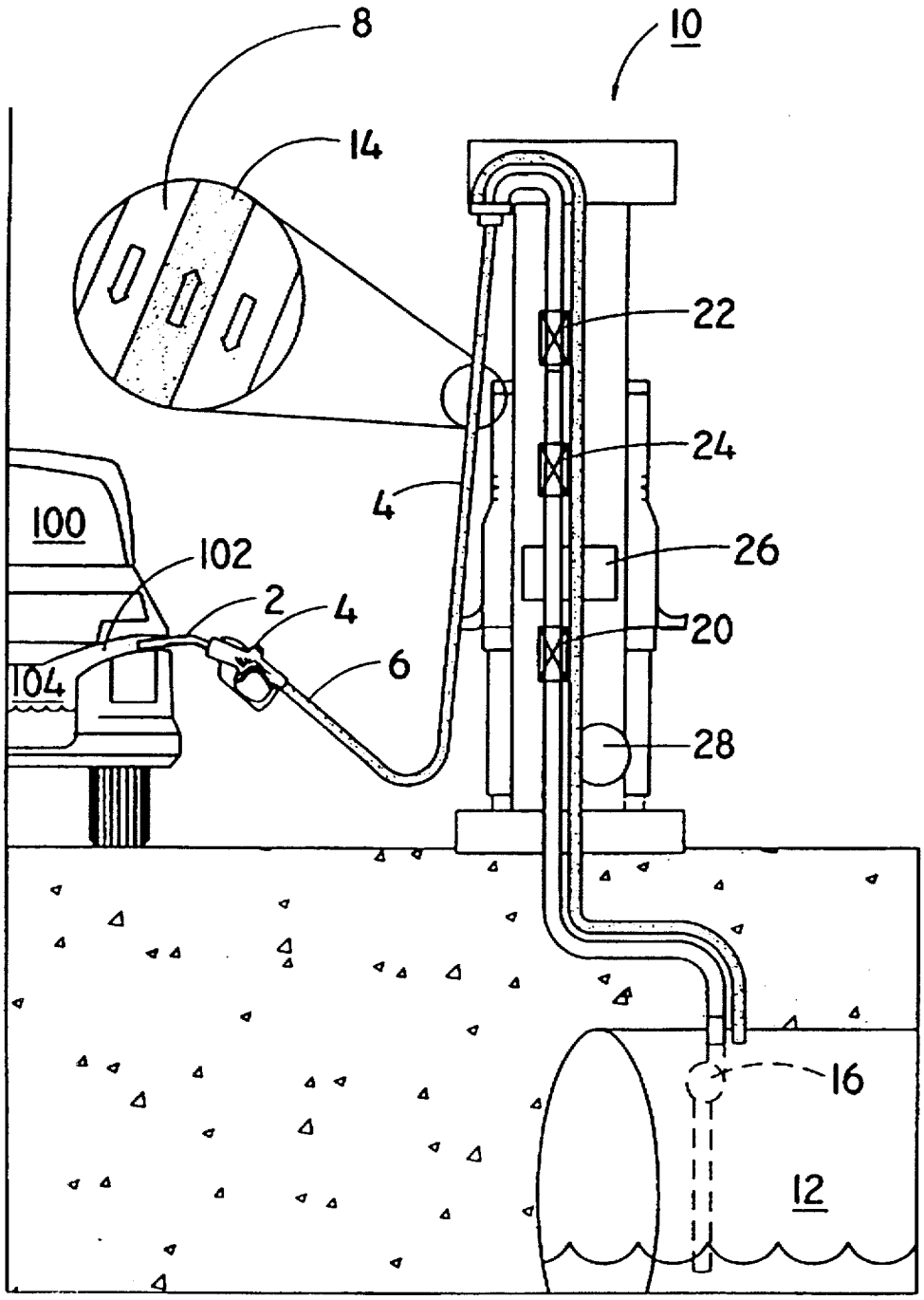
FIG. 1 is an elevational and partial sectional view of a typical gasoline dispenser having a vapor recovery system according to an embodiment of the present invention.

Referring now to the drawings in general and FIG. 1 in particular, it will be understood that the illustrations are for the purpose of describing a preferred embodiment of the invention and are not intended to limit the invention thereto. As best seen in FIG. 1, in a typical service station, an automobile 100 is shown being fueled from a gasoline dispenser 10. A spout 2 of nozzle 4 is shown inserted into a filler pipe 102 of a fuel tank 104 during the refueling of the automobile 100.

A fuel delivery hose 6 having vapor recovery capability is connected at one end to the nozzle 4, and at its other end to the fuel dispenser 10. As shown by the cutaway view of the interior of the fuel delivery hose 6, a fuel delivery passageway 8 is formed within the fuel delivery hose 6 for distributing gasoline pumped from an underground storage tank 12 to the nozzle 2. Gasoline is typically pumped by a delivery pump system 16 located within tank 12. The fuel delivery passageway 8 is typically annular within the delivery hose 6 and tubular from within the fluid dispenser 10 to the tank 12. The fuel delivery hose 6 typically includes a tubular vapor recovery passageway 14 for transferring fuel vapors expelled from the vehicle's fuel tank 104 to the underground storage tank 12 during the refueling of the vehicle 100.

A vapor recovery pump 28 provides a vacuum in the vapor recovery passageway 14 for removing fuel vapor during a refueling operation. The vapor recovery system using the pump 28 may be any suitable system such as those shown in U.S. Pat. Nos. 5,040,577 to Pope, 5,195,564 to Spalding, 5,333,655 to Bergamini et al., or 3,016,928 to Brandt. In addition, the invention is useful on dispensers that are not vapor recovery dispensers.

The fuel delivery passageway 8 typically includes a control valve 22, a positive displacement flow meter 24 and fuel filter 20. The fuel dispenser 10 also includes a control system 26 operatively associated with the control valve 22, flow meter 24 and the fuel pump 16.

In the preferred embodiment, the control valve 22 acts as a flow modulator, and the flow meter 24 acts as a fuel flow transducer.

Figure 2:
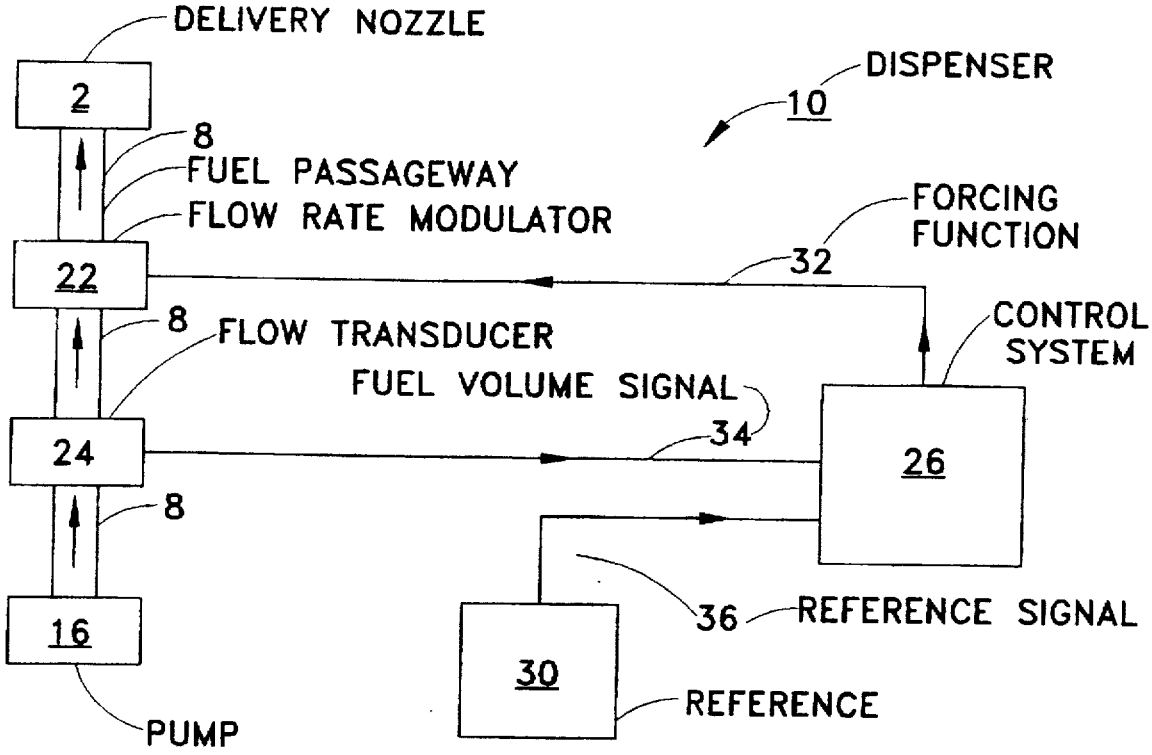
FIG. 2 is a block diagram illustrating a fuel dispenser's flow control system constructed according to an embodiment of the present invention.

Turning now to FIG. 2, the preferred embodiment employs one fuel flow transducer 24 which produces a fuel volume signal 34 by generating a digital transition for a given specific volume through the fuel flow transducer 24. The output of the fuel flow transducer 24 is fed to the control system 26. The control system 26 measures the period between the transitions of the fuel volume signal 34 to yield a numerical value inversely proportional to a flow rate through the fuel passageway 8. Alternatively, the control system 26 may count transitions in the fuel volume signal 34 over a fixed period of time to yield a numerical value directly proportional to the flow rate of fuel through the fuel passageway 8. With either method, the flow rate is compared with a desired reference value by the control system 26 to obtain system error. The reference signal may be stored or calculated by the control system 26 or read from a delivery rate reference source 30 via a delivery rate reference signal 36. The reference value may be a numerical coefficient or derived from an external source such as an oscillator whose input is processed in similar fashion to the flow measurement device. The reference may represent the maximum allowable delivery rate, a value representative of the desired system delivery rate or a value representing a flow-rate-dependent result.

The result of the comparison of the flow rate value and reference value represents an error value which is a scalar of the difference between the desired and actual fuel delivery rate. The error value is inputted into a conventional proportional-integral-derivative (PID) algorithm by the control system 26 to derive a forcing function 32 which is outputted to a flow rate modulator 22. The flow rate modulator 22 may include an electromechanically driven valve or any controllable flow restricting device. The flow rate modulator 22 is preferably actuated in proper phase with a servo loop.

Figure 3:
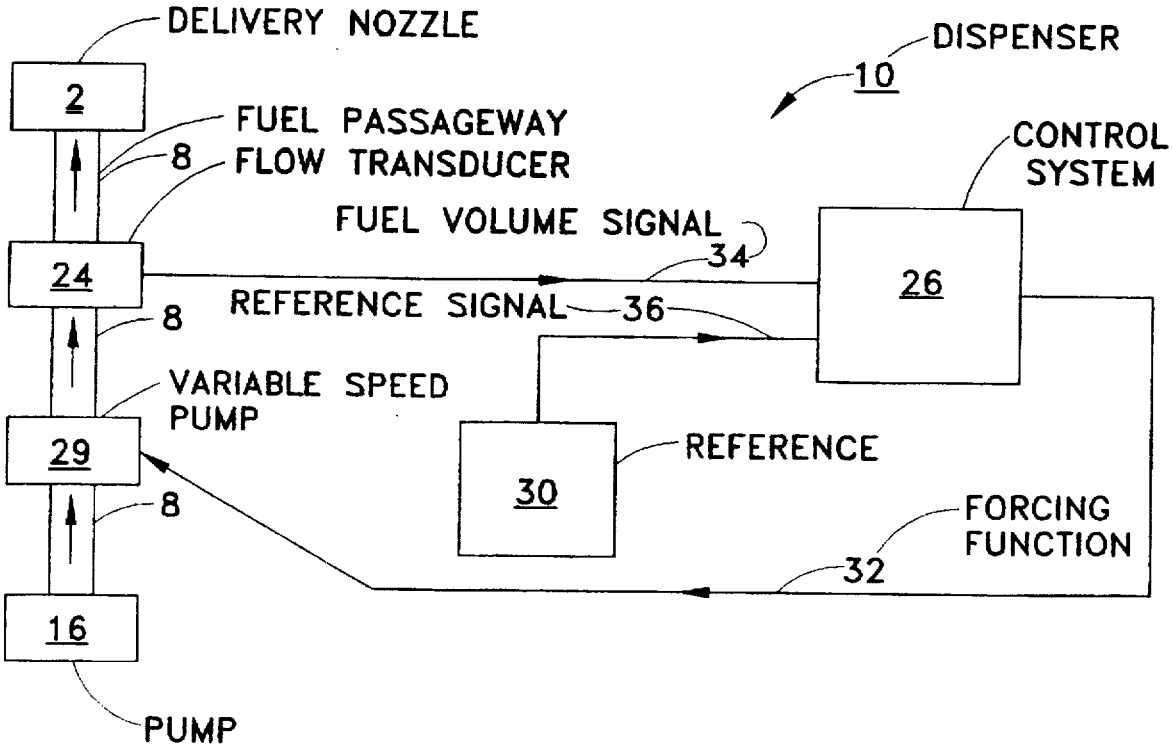
FIG. 3 is a block diagram illustrating an alternative embodiment of a fuel dispenser's flow control system constructed according to the present invention.

Turning now to FIG. 3, the forcing function may modulate the pumping rate of variable speed fuel pump 29.

Those of ordinary skill in the art are able to program control system 26 with a suitable PID algorithm. The preferred embodiments use a PID feedback control system with greater than unity gain. The PID feedback control system is easily implemented and the PID coefficients are chosen to compensate for any mechanical or electrical time constants and delays present in the fuel delivery system of the fuel dispenser 10, thereby effecting improved regulative response to dynamic changes imposed by site, dispenser, user or other variables which would otherwise affect unregulated fuel delivery rates.

The feedback control system may be modified and the regulatory functions still effectively implemented by deleting the derivative term at the compromise of delivery rate overshoot, undershoot or system response time. Alternatively, a unity or less than unity gain feedback control system may be implemented by modulating the flow rate modulator 22 or variable speed pump 29 at a rate equal to or less than the sum of mechanical and electrical system delays at greater compromise of delivery rate overshoot, undershoot or system response time. Those of ordinary skill in the art will recognize that other feedback systems of lesser or greater complexity and of lesser or greater performance may be implemented to achieve fuel delivery rate regulations. However, the preferred embodiment will include a reference signal or value representative of the desired delivery rate, a feedback signal or value comprising or representing the actual delivery rate, the digital, analog, mechanical or mixed embodiment processor which inputs the reference and feedback signals to derive a forcing function and a controlling device receiving the forcing function capable of modulating the fuel delivery rate. Systems requiring a lesser degree of accuracy or having a very precise and controllable flow rate modulator may not require feedback.

Applicant's invention provides a cost effective method to achieve product flow control in a gasoline dispenser by utilizing existing electronics and hydraulic components, by modifying the control software. Current gasoline dispensers have a controller 26 for controlling all functions of the dispenser, a positive displacement flow meter 24, and one or more control valves 22 for turning on or off the product flow. The controller can be modified to monitor the signals 34 from the flow meter 24, calculate an actual flow rate from signals 34 and send modulating signals 32 to control valve 22 to control the flow rate to desired levels, such as 10 GPM.

Figure 4:
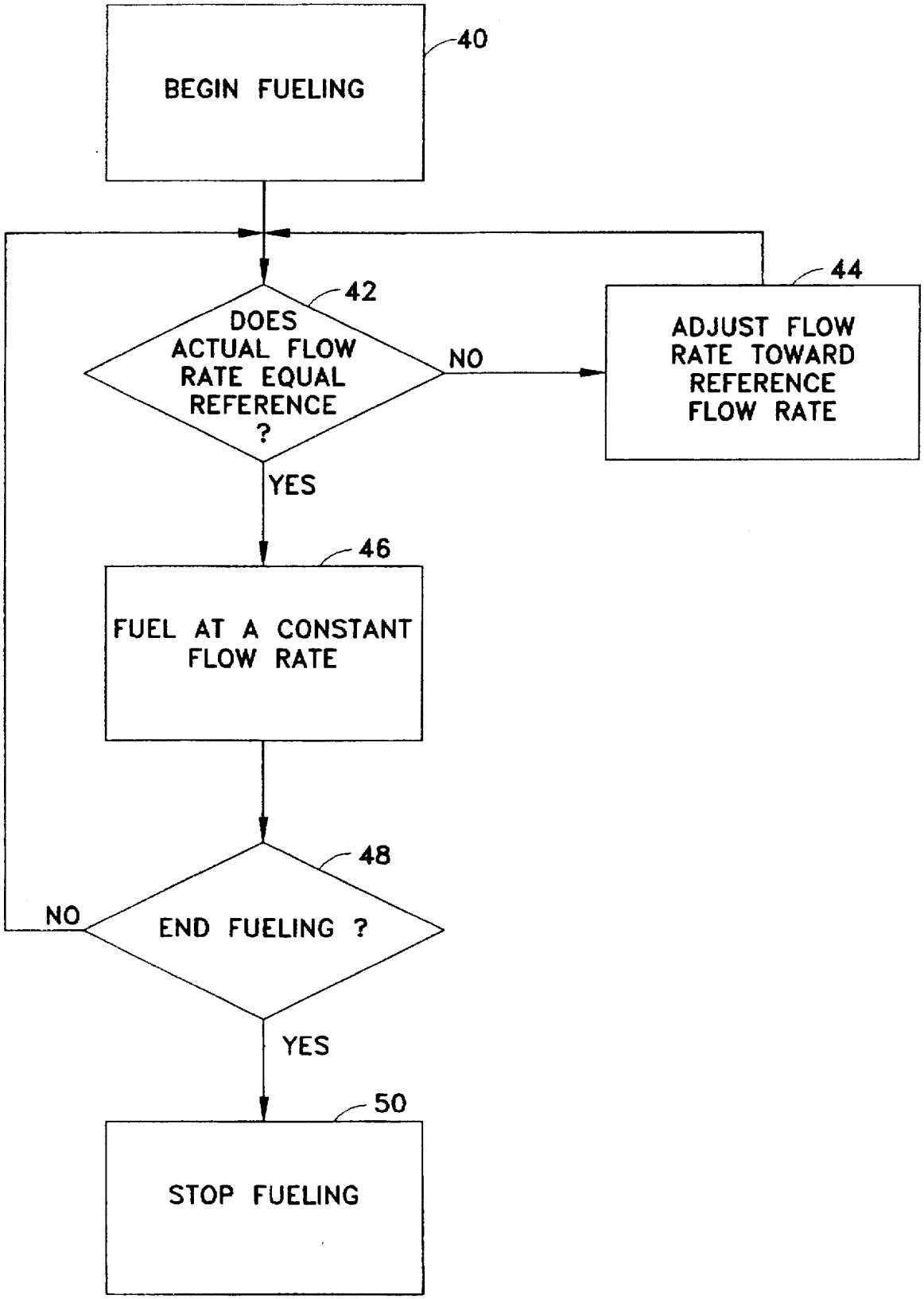
FIG. 4 is a flow chart depicting a control process for controlling the flow rate with respect to a reference flow rate according to one embodiment of the current invention.

In operation, the control system 26 (for either FIG. 2 or FIG. 3) may affect a variety of flow rate control functions to achieve a flow-rate-dependent result. The control system may be configured to control the flow rate according to a reference flow rate. As discussed above, the reference may come from within the control system 26 or be received from the reference 30. FIG. 4 depicts a basic control outline for a typical fueling operation. Block 40 indicates the beginning of a fueling operation. During the fueling operation, the controller determines whether the actual flow rate is equal to the reference or desired flow rate at decision block 42. If the rates are not equal, the flow rate is adjusted toward the reference or desired flow rate at block 44. Once the flow rate is adjusted at block 44, the controller returns to decision 42 to determine whether the actual and reference flow rates are equal. The flow rate is continually adjusted until the actual and reference flow rates are equal. Once the reference flow rate is achieved, the controller will deliver fuel at a constant flow rate at block 46. The controller 26 will check to see if the fueling operation is at an end at decision block 48. If the fueling operation is at an end, the controller 26 will stop fueling at block 50. If the fueling operation is not at an end, the controller 26 returns to decision block 42 to determine if the actual and reference or desired flow rates are equal. The process is repeated until fueling is stopped.

Figure 5:
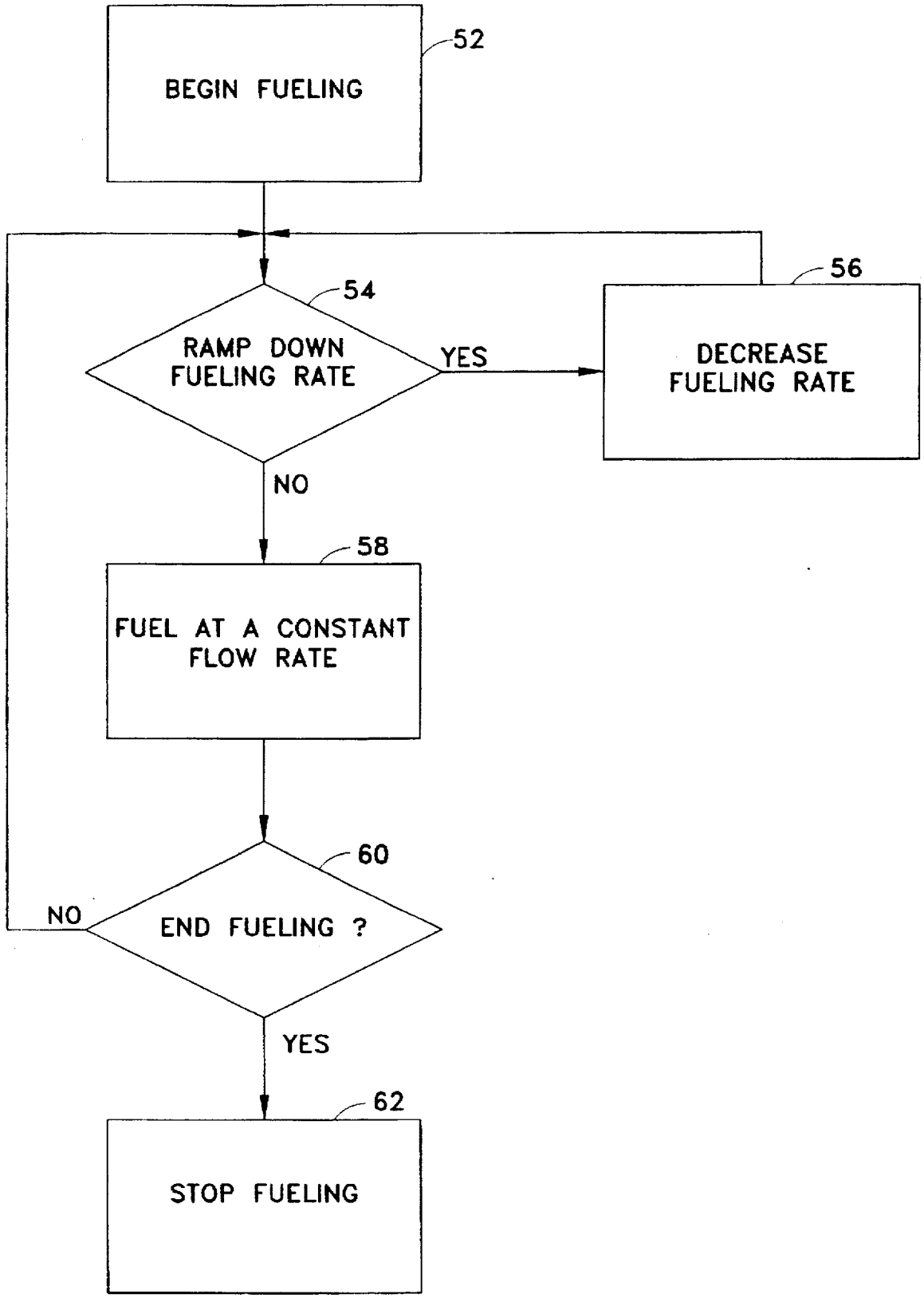
FIG. 5 is a flow chart depicting a control process for ramping down the fueling rate according to one embodiment of the current invention.

FIG. 5 is a flow chart setting out the basic control process for ramping down the fueling rate during a fueling operation. The fueling operation begins at block 52. The controller 26 determines whether to ramp down the fueling rate at decision block 54. The fueling rate is decreased accordingly at block 56, if necessary. Once the fueling rate is decreased, the control system 26 returns to decision block 54. When the fueling rate does not require ramping down, the control system 26 causes fuel to be delivered at a constant rate at block 58. The control system 26 next checks for an end to the fueling operation at decision block 60. If the fueling operation is at an end, the controller 26 stops fueling at block 62. If the fueling operation is not at an end, the control system 26 returns to decision block 54 and reiterates the process. Those of ordinary skill in the art will understand that the terms ramp or ramping will include not only constant and variable flow rate changes, but also abrupt step changes in flow rates. Ramping down the flow rate may be used to slow the rate of fueling for pre-set sales, assist the customer in smoothly ending the fueling operation, or adjust the flow rate to a lower desired or reference flow rate in order to optimize fueling and minimize spillage.

Figure 6:
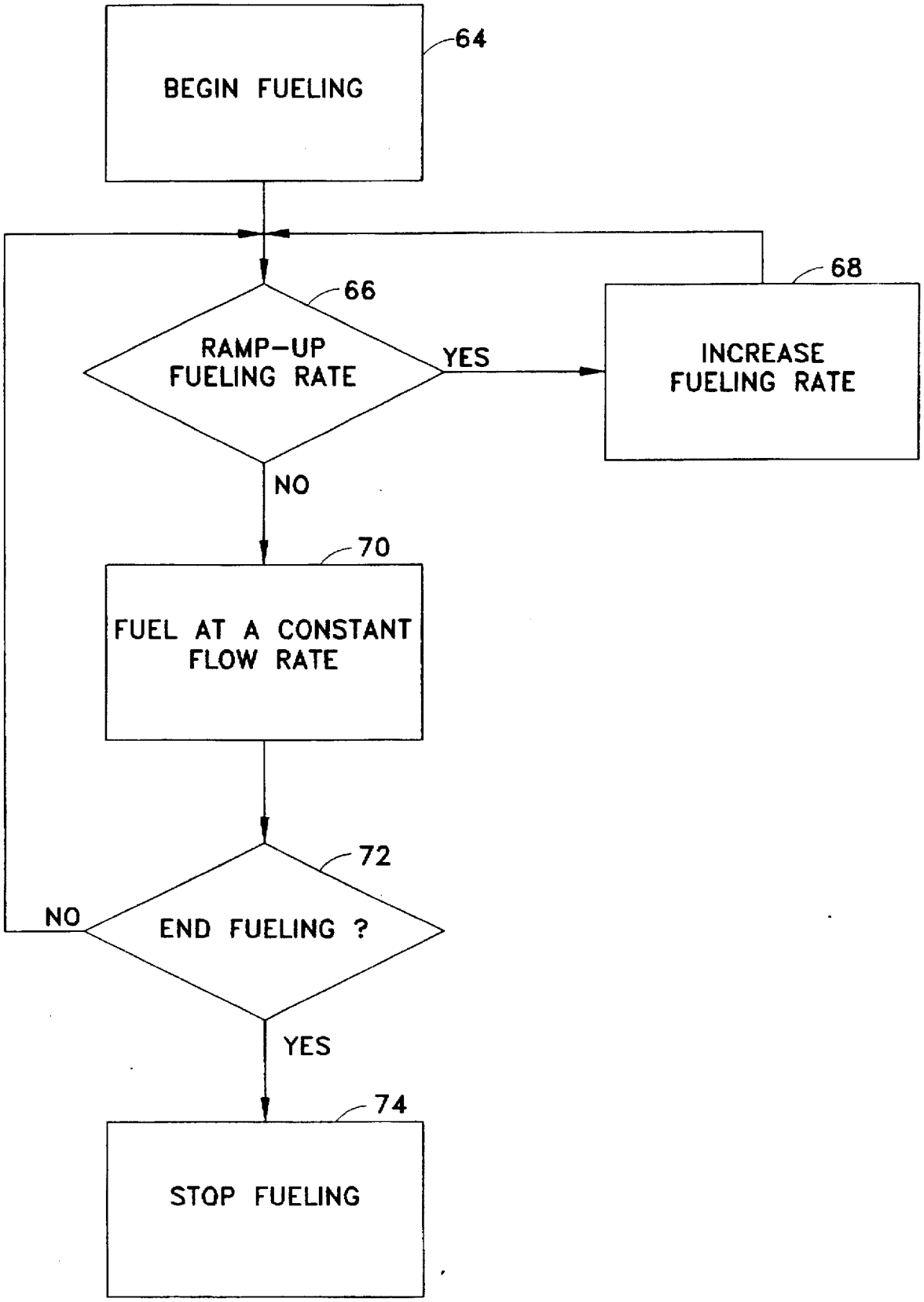
FIG. 6 is a flow chart depicting a control process for ramping up the fueling rate according to one embodiment of the current invention.

Likewise, the system may ramp up the flow rate from a reduced value to mitigate the initial surge at the onset of fueling to reduce fuel spillage or to increase the fueling rate to a desired or reference level. FIG. 6 depicts a flow chart for ramping up the flow rate. The fueling operation begins at block 64. During the fueling operation, the control system 26 determines whether it is necessary to ramp up the fueling rate at decision block 66. If the fueling rate needs increased, the control system 26 increases the fueling rate at block 68 and returns to decision block 66 to determine if a further increase is necessary. When the fueling rate does not require an increase, the control system 26 causes the delivery of fuel at a constant rate at block 70. The control system 26 determines whether the fueling operation is at an end at decision block 72. If the fueling operation is at an end, fueling is stopped at block 74. If the fueling operation is not at an end, the control system 26 returns to decision block 66 to reiterate the process.

Figure 7:
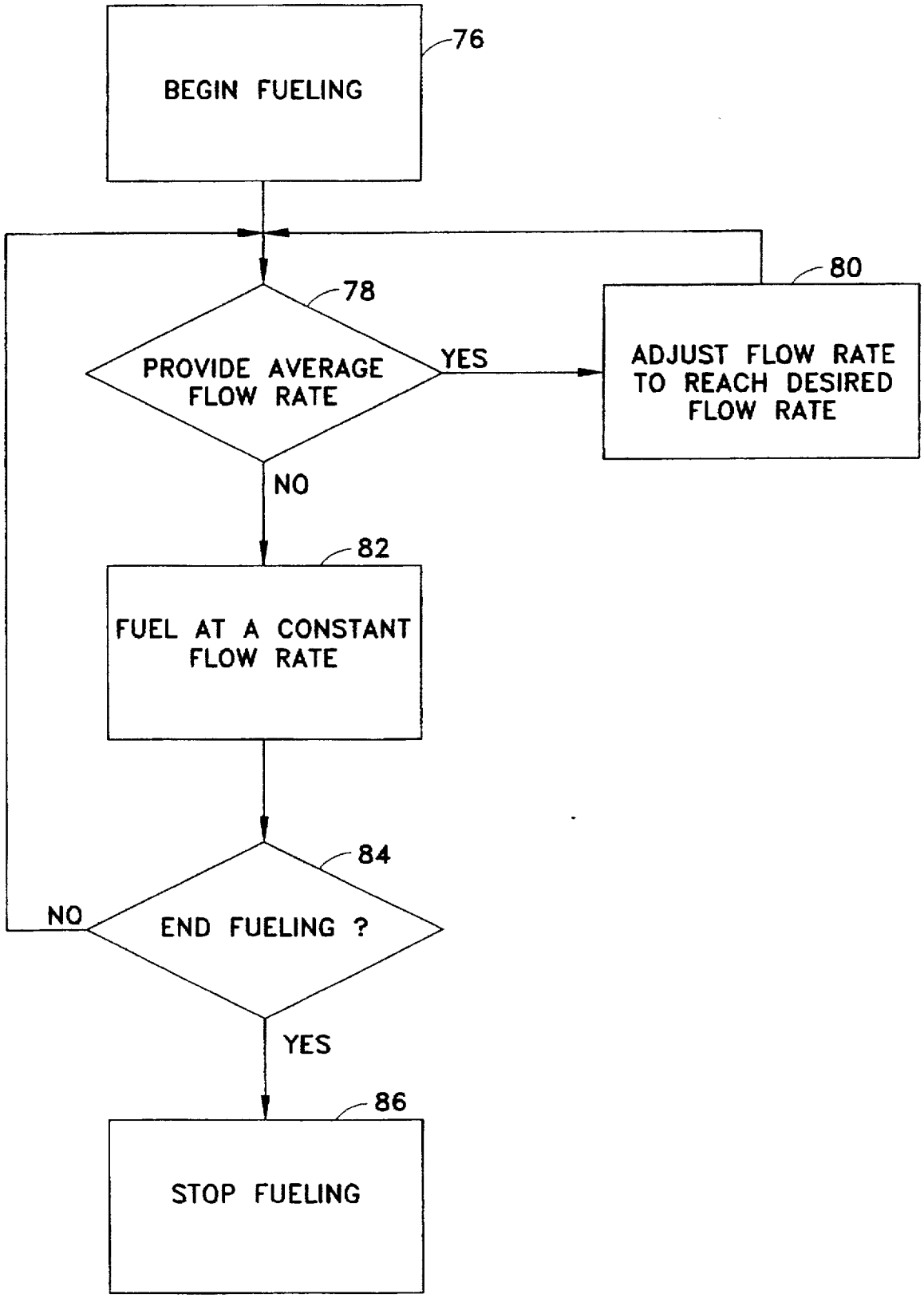
FIG. 7 is a flow chart depicting a control process for providing an average flow rate according to one embodiment of the current invention.

FIG. 7 provides a flow chart outlining a basic control process for providing a desired average flow rate during a portion of the fueling operation. The fueling operation begins at block 76. The control system determines whether or not to provide a desired average flow rate at decision block 78. If a desired average flow rate is required, the flow rate is adjusted in a manner calculated to reach the desired average flow rate at block 80. Providing an average flow rate allows the controller to deliver fuel at an average flow rate throughout a large portion of the fueling operation. For example, if the average fueling rate has to be 10 GPM or less during the fueling operation, the dispenser may deliver fuel significantly above 10 GPM to compensate for the lower delivery rates during the beginning and/or end of the fueling operation. This feature achieves two major goals: first, a station operator improves customer throughput and second, customers receive fuel in a faster and safer manner. Such control is currently unavailable in the industry.

Once the average flow rate is achieved, the control system causes fueling at a constant rate at block 82. The control system determines whether the fueling operation is at an end at decision block 84. If the fueling operation is at an end, fueling is stopped at block 86. If the fueling operation is not at an end, the control system 26 returns to decision block 78 to further check and/or adjust the fueling rate to provide the desired average flow rate. The control system 26 may also control the rate of flow in the delivery path to provide a predetermined average rate of flow during various portions of the fueling operation.

Figure 8:
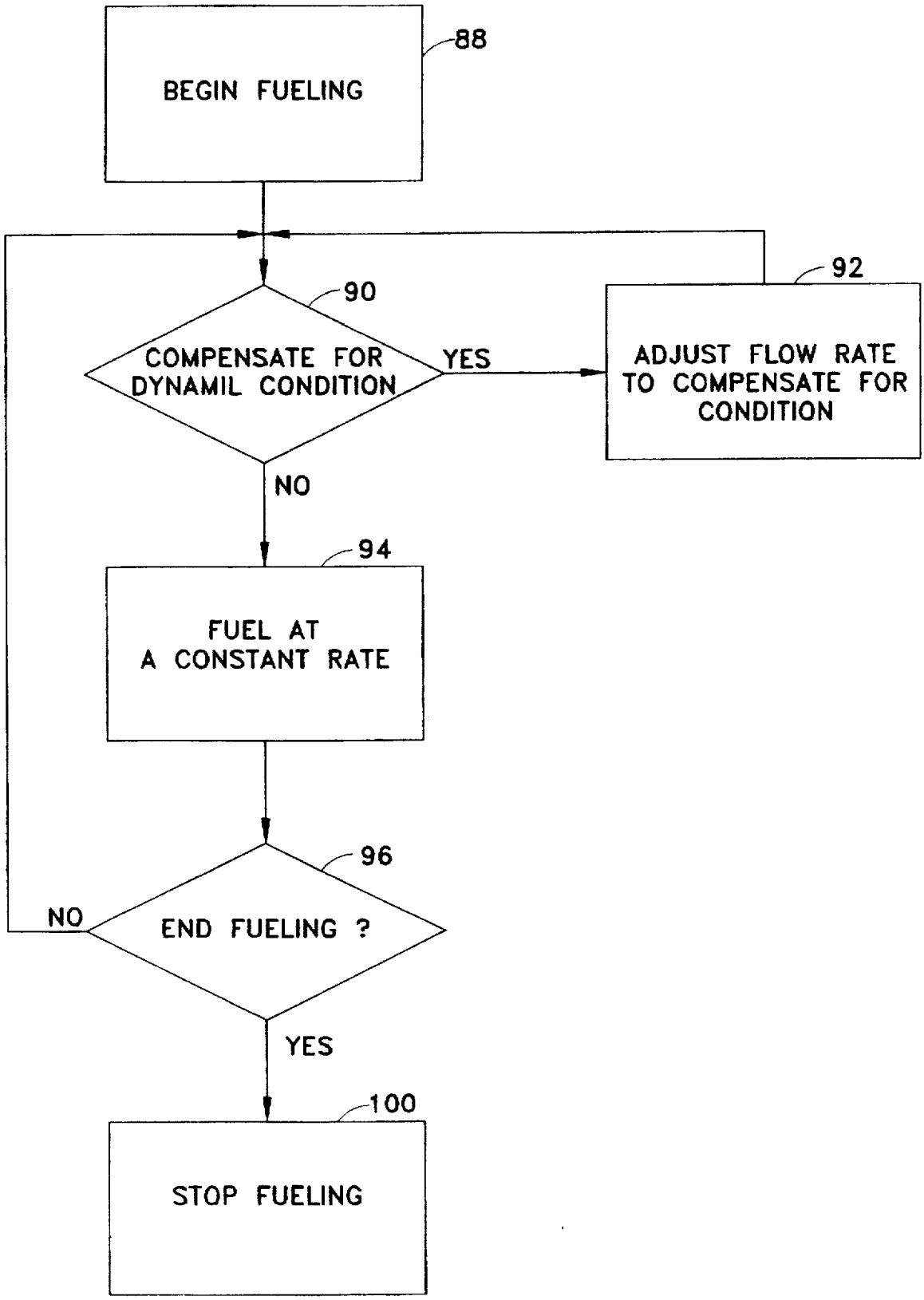
FIG. 8 is a flow chart depicting a control process for compensating for dynamic conditions according to one embodiment of the current invention.

FIG. 8 is a flow chart depicting a control process similar to that of FIG. 7. FIG. 8 provides a control process capable of compensating for dynamic changes in the fueling operation. The cause of these dynamic changes are often due to pressure changes in the fuel delivery system when multiple dispensers are turned on or off during the fueling operation, or a customer manually or accidentally adjusts the fueling rate or causes a premature cut-off. Current technology does not allow the dispenser to recover and continue to deliver fuel at a high average delivery rate. Current systems are restricted to delivering fuel at the maximum flow rate allowed by the mechanical flow restrictors. In most cases, reduced system feed pressure prevents fueling at rates equal to the mechanical flow restrictors' maximum allowable flow rate.

The current invention overcomes the inherent limitations of the mechanical restrictors by allowing fuel delivery rates to instantaneously and periodically rise above the average flow rates set by governmental regulations to provide an average flow rate meeting these regulations.

The fueling operation begins at block 88. The control system 26 determines whether there is a need to compensate for a dynamic change occurring during the fueling operation at decision block 90. If such a change is necessary, the control system 26 adjusts the flow rate to compensate for the condition at block 92 and returns to decision block 90 in an iterative manner. If the control system does not need to compensate for a dynamic condition, the fueling rate is held constant at block 94. The control system 26 determines whether the fueling operation is at an end at decision block 96. If the fueling operation is at an end, the control system 26 stops fueling at block 100. If the fueling operation is not at an end, the control system 26 returns to decision block 90 to determine whether the fueling rate requires further compensation.

Figure 9:
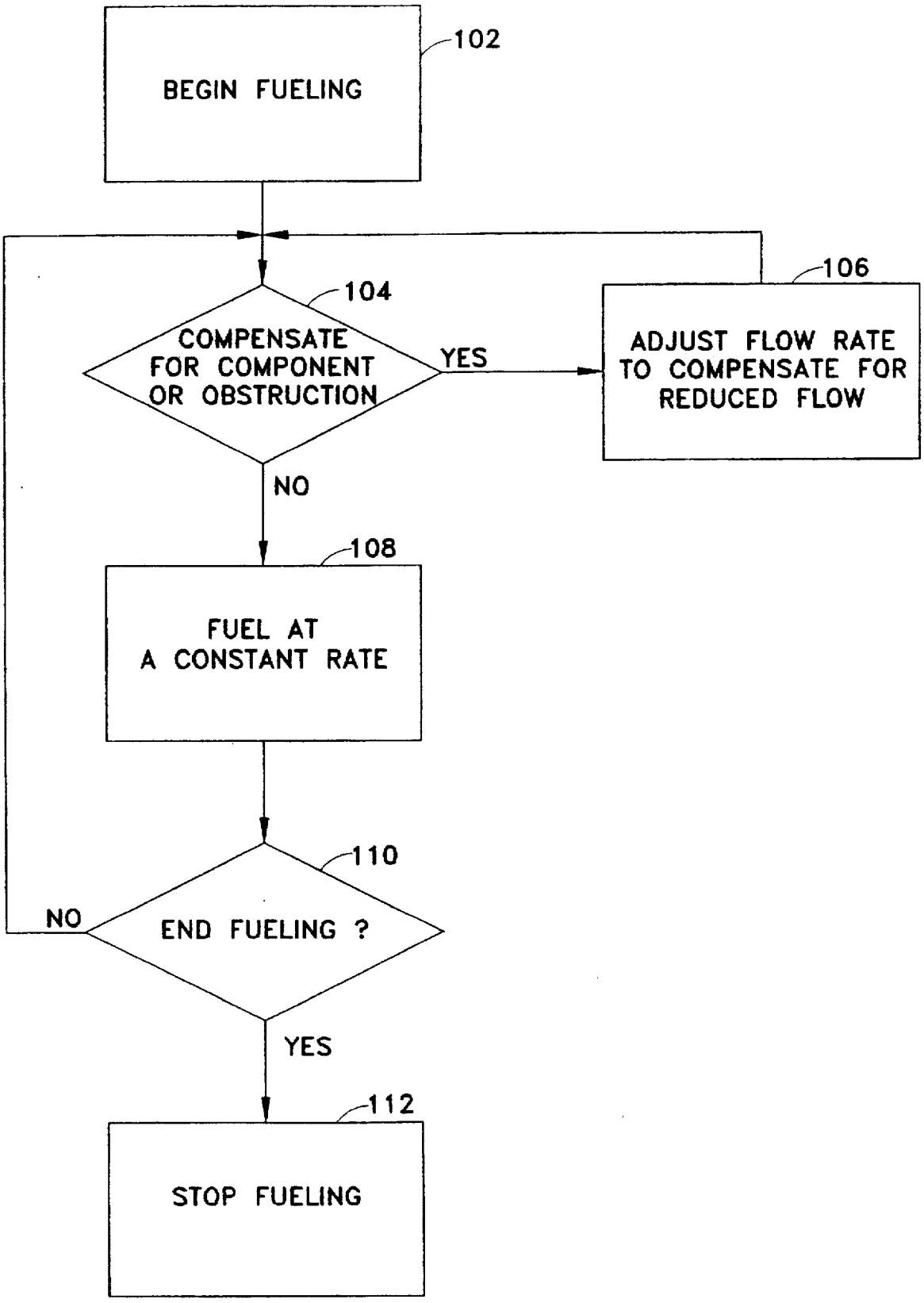
FIG. 9 is a flow chart depicting a control process for compensating for component deterioration or fuel passageway obstruction according to one embodiment of the current invention.

FIG. 9 depicts a flow chart outlining a control process for compensating delivery rates for deteriorating components which nominally reduce flow, such as fuel filters and kinked hoses, or other obstructions within the fuel passageway 8. Currently available fuel dispenser systems are unable to utilize excess site delivery capacity to automatically compensate for conditions negatively affecting flow.

Typically, additional restrictions simply further reduce flow rates substantially below allowed delivery rates. The current invention overcomes the limitations of the prior art by eliminating the need for mechanically restrictive orifices and utilizing a control valve 22. Many dispensers already include such a valve. When deteriorating components or passageway obstructions reduce flow rates, the current invention can use excess delivery capacity in conjunction with the control valve 22 in an effort to compensate for additional restrictions.

The fueling operation begins at block 102. The control system 26 determines whether or not to compensate for component deterioration or other obstructions unduly limiting delivery rates at decision block 104. If compensation is required, the control system adjusts the flow rate in an effort to compensate for the reduced flow at block 106 and returns to decision block 104 in an iterative manner. Once compensation is complete, the control system 26 causes fueling at a constant rate at block 108. The control system 26 next determines whether the fueling operation is at an end at decision block 110. If the fueling operation is at an end, fueling is stopped at block 112. If the fueling operation is not at an end, the control system 26 returns to decision block 104 in an iterative manner.

Figure 10:
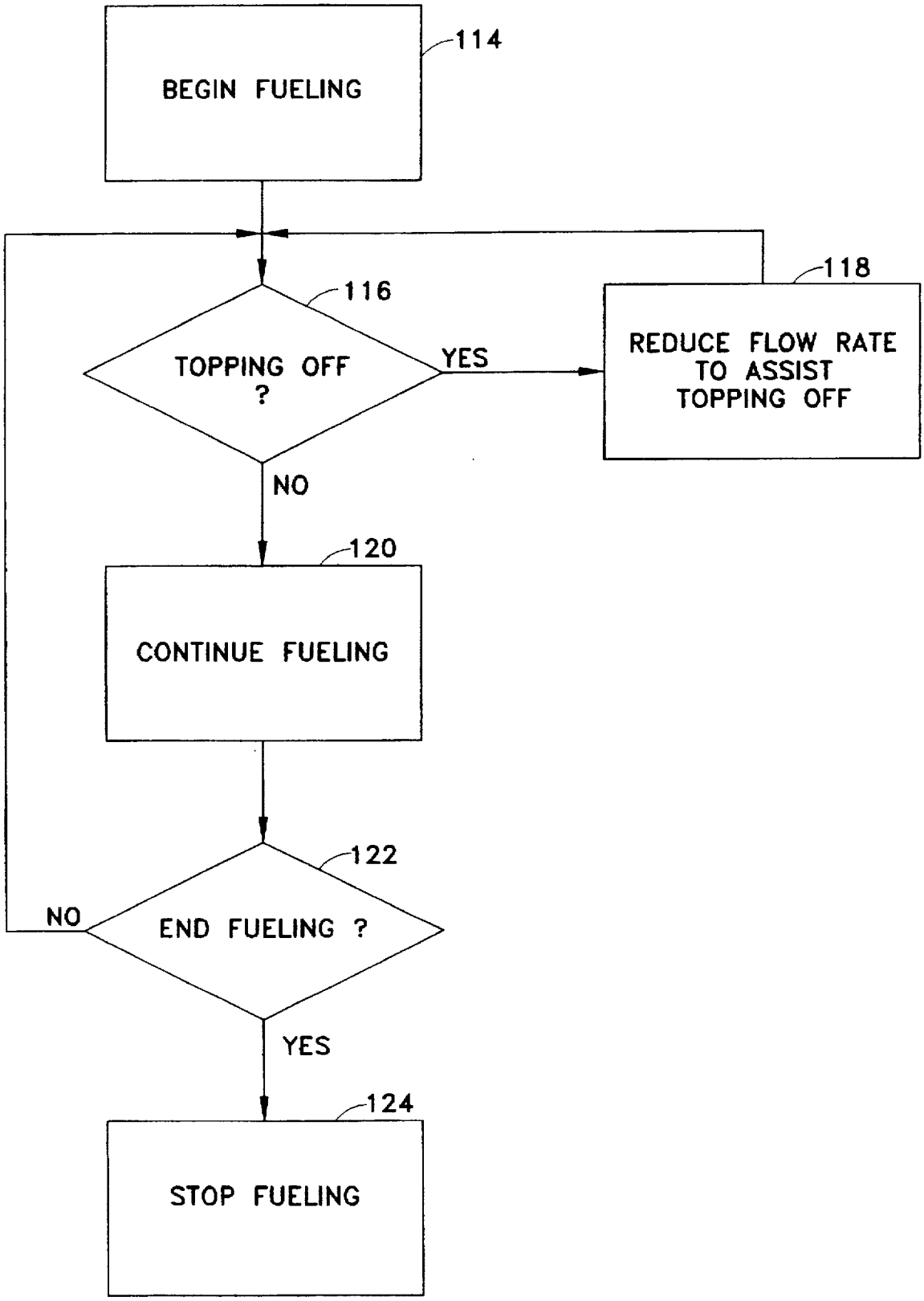
FIG. 10 is a flow chart depicting a control process for controlled topping off according to one embodiment of the current invention.

Equally important as optimizing the delivery of fuel during a fueling operation is minimizing the amount of fuel spilled during the operation. The enhanced control over the fueling operation provided by the current invention minimizes the amount of fuel spilled by controlling flow rates in a manner reducing the possibility of fuel spills. FIG. 10 is a flow chart depicting a control process for assisting a user in topping off a fueling operation in a manner minimizing the potential for spilling fuel. The fueling operation begins at block 114. Nearing the end of the fueling operation, the control system 26 determines whether or not the user is at or near a topping off point in the fueling operation. The system may recognize that the topping off point is near at decision block 116 when automatic shutoffs begin to occur, a pre-set sale or amount is being reached, or the fuel dispenser has received information from the operator or vehicle regarding the amount of fuel necessary to fill the tank. If a topping off point in the fueling operation occurs, the control system 26 reduces the flow rate in a manner assisting topping off and minimizing the potential for spilling fuel at decision block 118 and returns to decision block 116. If the system is not near the topping off point, the control system 26 continues fueling at block 120. The control system 26 subsequently determines whether the fueling operation is at an end at block 122. If the fueling operation is at an end, fueling is stopped at block 124. If the fueling operation is not at an end, the control system 26 returns to decision block 116 in an iterative manner. The topping off control process of FIG. 10 may also provide further fueling optimization. By reducing the flow rate to zero in a controlled fashion, the slow, spill prone, manual topping off method currently used will be replaced by a quicker and safer fueling operation.

Figure 11:
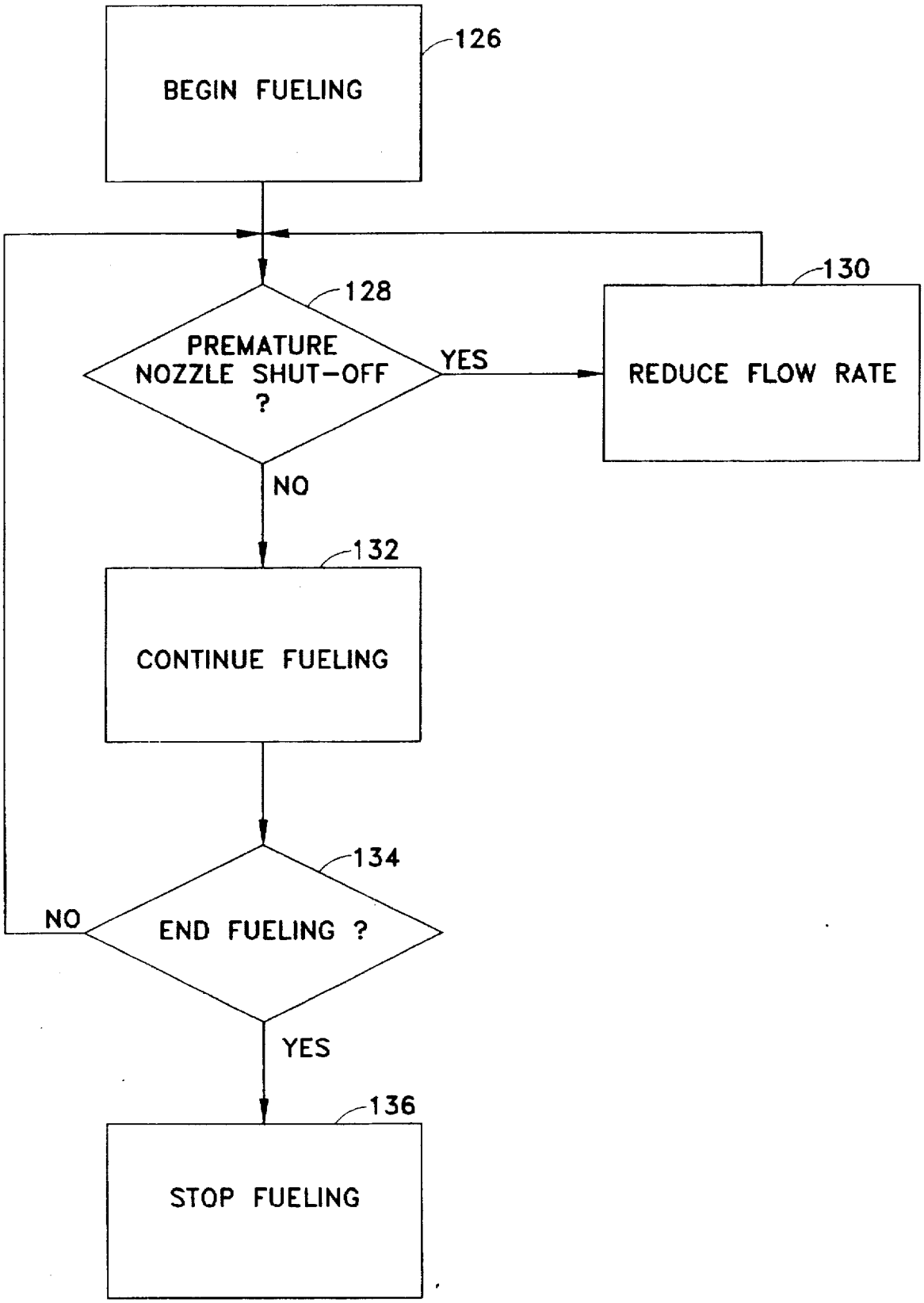
FIG. 11 is a flow chart depicting a control process for reducing flow rates in response to a premature nozzle shutoff according to one embodiment of the current invention.
Figure 12:
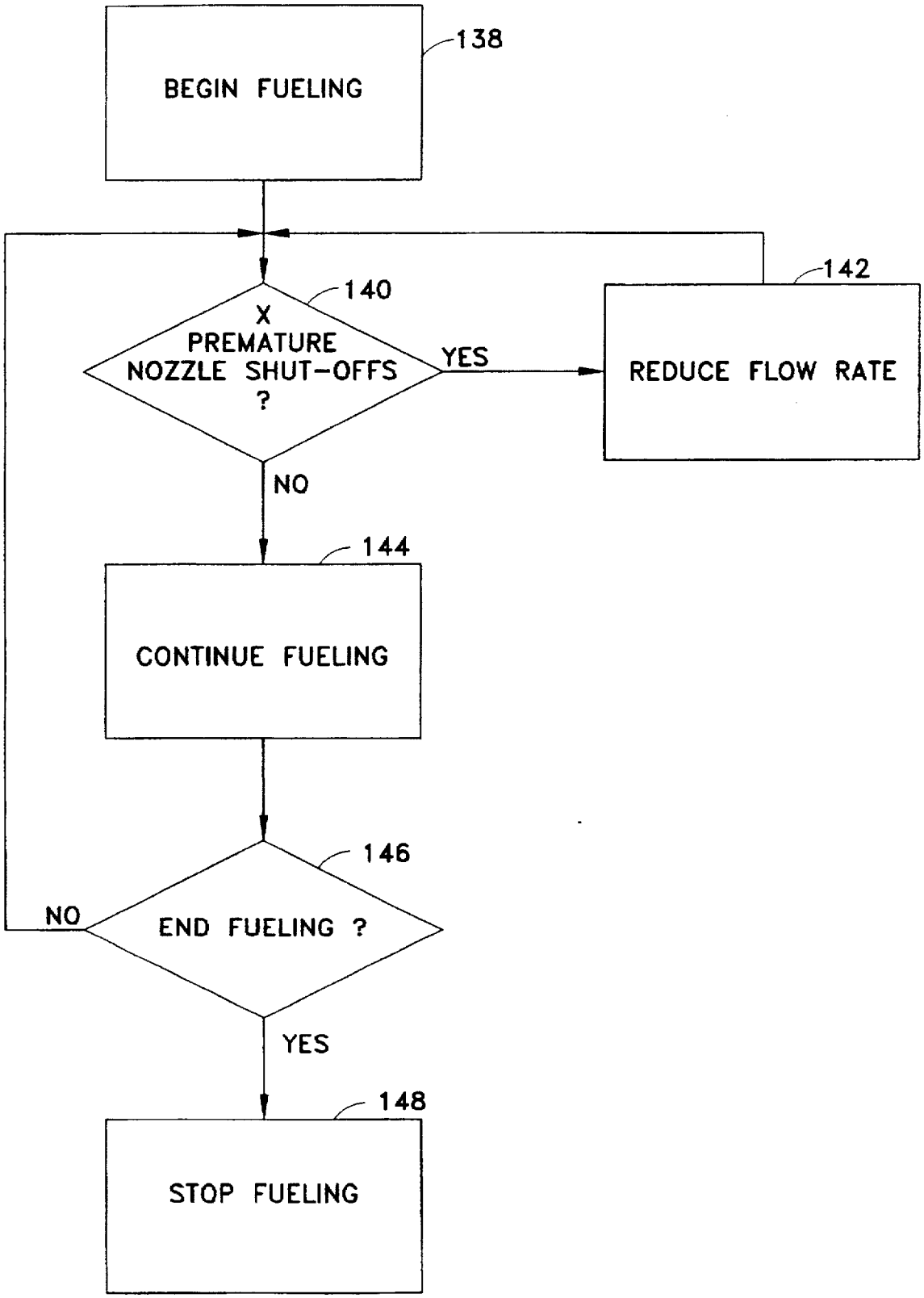
FIG. 12 is a flow chart depicting a control process for controlling flow rates in response to a certain number of premature nozzle shutoffs according to one embodiment of the current invention.
Figure 13:
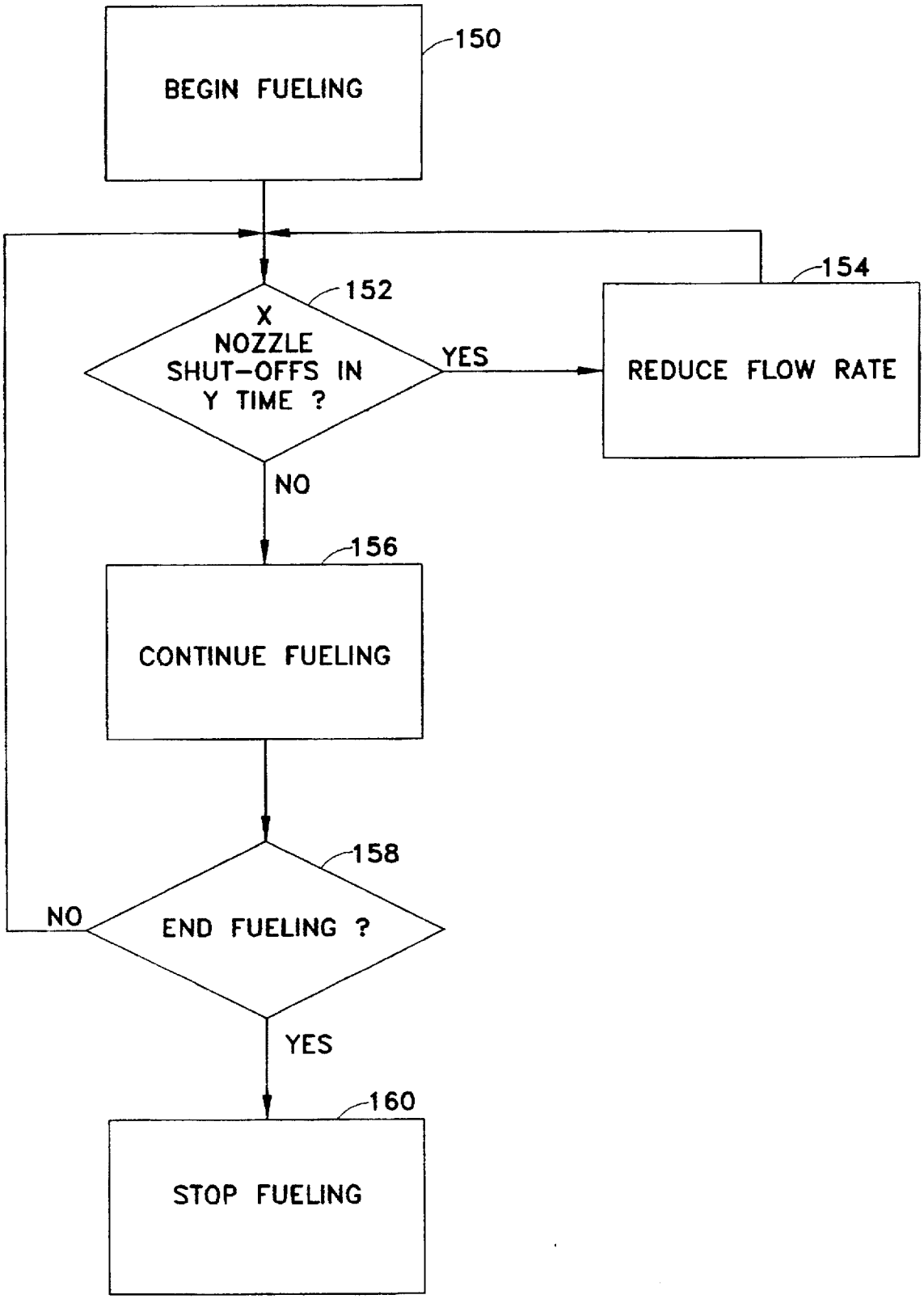
FIG. 13 is a flow chart depicting a control process for reducing flow rates in response to a certain number of nozzle shutoffs during a predetermined period of time according to one embodiment of the current invention.

FIGS. 11–13 depict a control process for reducing flow rates when one or more premature nozzle shutoffs occur in sequence or during a predetermined period of time. In FIG. 11, the fueling operation begins at block 126. The control system 26 determines whether a premature nozzle shutoff has occurred at decision block 128. If a shutoff has occurred, the flow rate is reduced in a manner minimizing the potential for spilling fuel, yet attempting to optimize the fueling operation at block 130. The control system 26 returns to decision block 128 in an iterative manner. If there is no premature nozzle shutoff, the fueling operation is continued at block 132 until the fueling operation reaches an end. The control system 26 determines whether the fueling operation reaches an end at decision block 134. If the fueling operation is at an end, fueling is stopped at block 136. If the fueling operation is not at an end, the control system 26 returns to decision block 128 in an iterative manner.

In FIG. 12, the fueling operation begins at block 138. The control system 26 determines whether a certain number of premature nozzle shutoffs have occurred at decision block 140. If such a number has occurred, the flow rate is reduced accordingly at block 142 and the control system 26 returns to decision block 140 in an iterative manner. If the certain number of premature nozzle shutoffs have not occurred, fueling is continued at block 144 and the control system looks for an end to the fueling operation at decision block 146. If the fueling operation is at an end, fueling is stopped at block 148. If the fueling operation is not at an end, the control system 26 returns to decision block 140 in an iterative manner.

A further refinement of the control process of FIG. 12 is that of FIG. 13. The fueling operation begins at block 150. The control system 26 determines whether a certain number of nozzle shutoffs occur within a predetermined period of time at decision block 152. If such condition occurs, the flow rate is reduced accordingly to minimize fuel spillage while optimizing the fueling operation at block 154. Once the flow rate is reduced, the control system 26 returns to decision block 152 in an iterative manner. If the nozzle shutoff condition is not satisfied, the control system 26 continues fueling at block 156 and looks for an end to the fueling operation at decision block 158. If the fueling operation is at an end, fueling is stopped at block 160. If the fueling condition is not at an end, the control system 26 returns to decision block 152 in an iterative manner.

Figure 14:
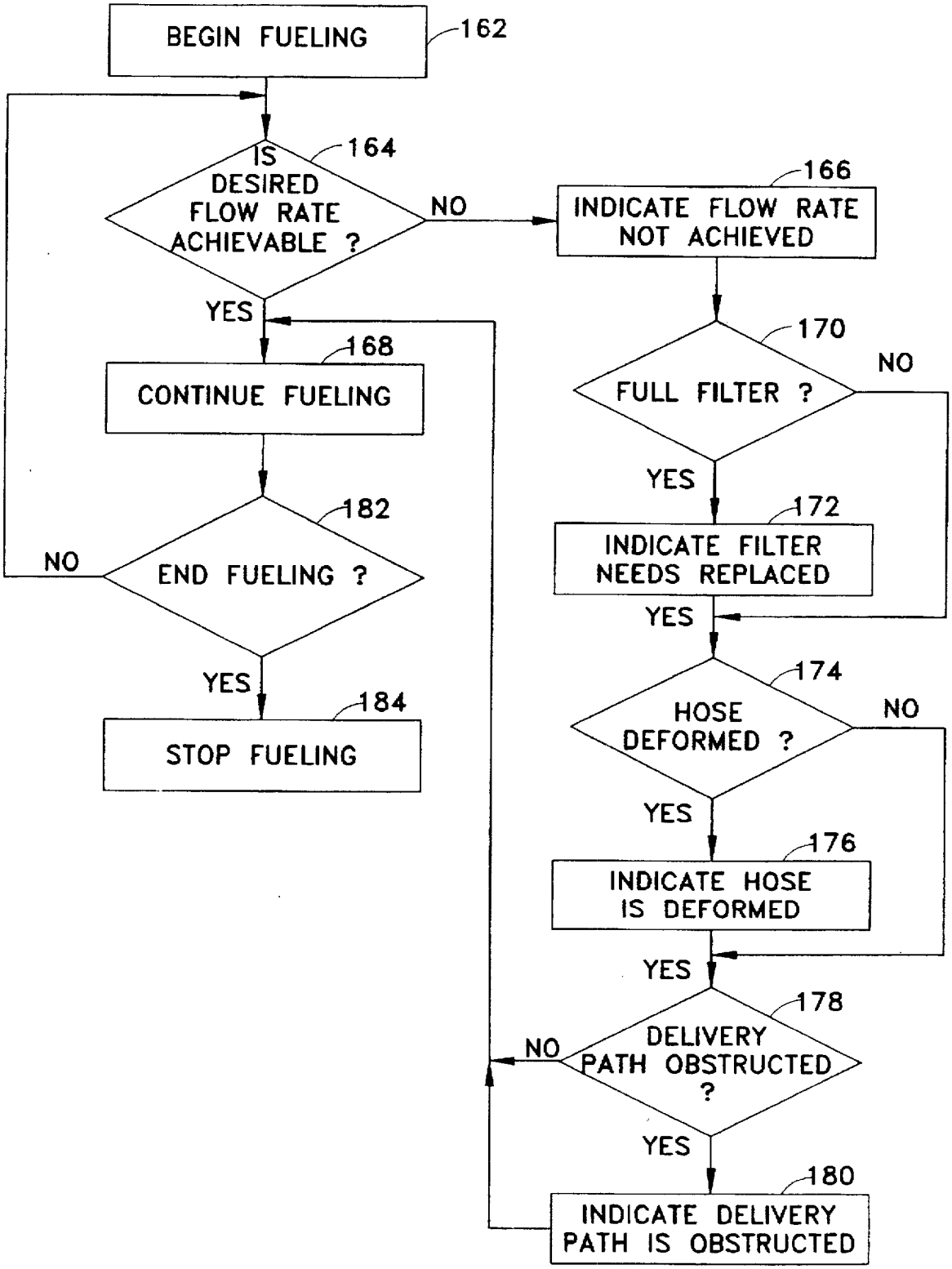
FIG. 14 is a flow chart depicting a control process for indicating a flow rate is not achievable according to one embodiment of the current invention.

Another advantage of the current invention is the ability to provide various warnings or indications of problems associated with the delivery path. Among other indications, the current system may be configured to indicate when a certain flow rate is not achieved or unachievable, the fuel filter is clogged or needs replaced, a delivery hose is deformed, or the delivery path is otherwise obstructed. FIG. 14 depicts a basic control process allowing the control system 26 to indicate when one or more of the above-mentioned problems arise during a fueling operation. The fueling operation begins at block 162. The control system 26 determines whether or not the desired flow rate is achievable at decision block 164. If the desired flow rate is unachievable, the control system 26 indicates that the flow rate is not achieved at block 166. The control system next attempts to determine whether the filter is causing the reduced flow rates at decision block 170. If the filter is the problem, the control system 26 indicates that the filter needs attention at block 172. The control system 26 next determines whether or not the reduced flow rates are caused by a deformed or kinked delivery hose at decision block 174. The control system 26 will also progress to decision block 174 if the fuel filter is not causing reduced flow.

If a hose is deformed, the control system 26 indicates this at block 176 and proceeds to determine whether or not the delivery path is otherwise obstructed at decision block 178. The control system 26 also progresses to decision block 178 after a determination that the delivery hose is not causing the reduced flow. If the delivery path is otherwise obstructed, the control system 26 will indicate so at block 180 and continue fueling at block 168. If the delivery path is not otherwise obstructed, the control system 26 will continue fueling at block 168.

If the desired flow rate is achievable, as determined at decision block 164, the control system 26 will continue fueling at block 168. At this point, the control system 26 determines whether the fueling operation is at an end at decision block 182. If the fueling operation is at an end, fueling is stopped at block 184. If the fueling operation is not at an end, the control system 26 returns to decision block 164 in an iterative manner, further checking delivery rates.

Those of ordinary skill in the art will realize that the various functions and embodiments discussed in conjunction with FIGS. 4–11 may be modified and combined in numerous ways, all of which are deemed within the scope of the applicant's invention. The aspects were discussed individually in the corresponding figures to better describe the respective embodiments. Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A precision fuel dispenser comprising:

a fuel dispenser for delivering fuel along a fuel delivery path;

a flow rate modulator in said fuel delivery path; and a control system operatively associated with said flow rate modulator for regulating the rate of flow in said fuel delivery path during a portion of a fueling operation to define a flow-rate-dependent fueling process including controlling the rate of flow in said delivery path to provide a defined average flow rate during a portion of the fueling operation by increasing or decreasing the flow rate above or below the defined average flow rate to compensate for any periods that varied from the defined average flow rate.

2. The precision fuel dispenser of claim 1 further comprising a flow transducer in said fuel delivery path configured to provide a flow transducer signal representing a volume of fuel flow in said fuel delivery path to said control system.

3. The precision fuel dispenser of claim 2 wherein said control system is adapted to derive a forcing function from differences between an actual flow rate determined from said flow transducer signal and a desired flow rate, said control system regulates the rate of flow in said fuel delivery path according to said forcing function.

4. The precision fuel dispenser of claim 2 wherein said control system is configured to indicate when a certain rate of flow is not achievable.

5. The precision fuel dispenser of claim 2 wherein said control system is configured to indicate when fuel flow is inhibited.

6. The precision fuel dispenser of claim 2 wherein said control system is configured to indicate when a filter needs replaced, a delivery hose is deformed or said delivery path is otherwise obstructed.

7. The precision fuel dispenser of claim 2 wherein said flow rate transducer includes a flow meter and said transducer signals include volumetric pulses to said control system.

8. The precision fuel dispenser of claim 1 wherein said control system has a reference flow rate representing a desired flow rate, said control system is adapted to regulate the rate of flow in said fuel delivery path to achieve said reference flow rate.

9. The precision fuel dispenser of claim 1 wherein said control system is configured to ramp up the rate of flow in said delivery path from a lower rate of flow.

10. The precision fuel dispenser of claim 1 wherein said control system is configured to ramp down the rate of flow in said delivery path from a higher rate of flow.

11. The precision fuel dispenser of claim 1 wherein said control system is configured to control the rate of flow in said delivery path to provide a predetermined average rate of flow during most of the fueling operation.

12. The precision fuel dispenser of claim 1 wherein said control system is configured to control the rate of flow in said delivery path to provide a predetermined rate of flow under varying dynamic conditions.

13. The precision fuel dispenser of claim 1 wherein said control system is configured to control the rate of flow in said delivery path to provide a predetermined average rate of flow under varying dynamic conditions.

14. The precision fuel dispenser of claim 1 wherein said control system is configured to control the rate of flow in said delivery path to provide a reduced rate of flow after a premature automatic shut-off.

15. The precision fuel dispenser of claim 1 wherein said control system is configured to control the rate of flow in said delivery path to assist in topping off a fueling operation.

16. The precision fuel dispenser of claim 1 wherein said control system is configured to control the rate of flow in said delivery path to provide a reduced rate of flow when a predetermined number of automatic shut-offs occur.

17. The precision fuel dispenser of claim 1 wherein said control system is configured to control the rate of flow in said delivery path to provide a reduced rate of flow when a predetermined number of automatic shut-offs occur within a predetermined period of time.

18. The precision fuel dispenser of claim 1 wherein said control system is configured to control the rate of flow in said delivery path to compensate for deteriorating components which reduce flow.

19. The precision fuel dispenser of claim 1 wherein said flow rate modulator includes a control valve.

20. A method of delivering fuel comprising:

delivering fuel along a fuel delivery path;

modulating fuel flow in said fuel delivery path; and controlling the modulation of fuel flow to regulate the rate of flow in said fuel delivery path during a portion of a fueling operation to achieve a flow-rate-dependent result by increasing or decreasing the flow rate above or below the flow-rate-dependent result to compensate for any periods that varied from the flow-rate-dependent result.

21. The method of delivering fuel of claim 20 further comprising providing a flow signal representing a volume of fuel flow in the fuel delivery path.

22. The method of delivering fuel of claim 21 further comprising deriving a forcing function from differences between an actual flow rate determined from the flow signal and a desired flow rate and regulating the rate of flow in said fuel delivery path according to the forcing function.

23. The method of delivering fuel of claim 21 further comprising indicating when a certain rate of flow is not achievable.

24. The method of delivering fuel of claim 21 further comprising indicating when fuel flow is inhibited.

25. The method of delivering fuel of claim 21 further comprising indicating when a filter needs replaced, a delivery hose is deformed or said delivery path is otherwise obstructed.

26. The method of delivering fuel of claim 20 further comprising providing a reference flow rate representing a desired flow rate and regulating the rate of flow in the fuel delivery path to achieve the reference flow rate.

27. The method of delivering fuel of claim 20 further comprising ramping up the rate of flow in said delivery path from a lower rate of flow.

28. The method of delivering fuel of claim 20 further comprising ramping down the rate of flow in said delivery path from a higher rate of flow.

29. The method of delivering fuel of claim 20 further comprising controlling the rate of flow in said delivery path to provide a predetermined average rate of flow during most of the fueling operation.

30. The method of delivering fuel of claim 20 further comprising controlling the rate of flow in said delivery path to provide a predetermined rate of flow under varying dynamic conditions.

31. The method of delivering fuel of claim 20 further comprising controlling the rate of flow in said delivery path to provide a predetermined average rate of flow under varying dynamic conditions.

32. The method of delivering fuel of claim 20 further comprising controlling the rate of flow in said delivery path to provide a reduced rate of flow after a premature automatic shut-off.

33. The method of delivering fuel of claim 20 further comprising controlling the rate of flow in said delivery path to assist in topping off a fueling operation.

34. The method of delivering fuel of claim 20 further comprising controlling the rate of flow in said delivery path to provide a reduced rate of flow when a predetermined number of automatic shut-offs occur.

35. The method of delivering fuel of claim 20 further comprising controlling the rate of flow in said delivery path to provide a reduced rate of flow when a predetermined number of automatic shut-offs occur within a predetermined period of time.

36. The method of delivering fuel of claim 20 further comprising controlling the rate of flow in said delivery path to compensate for deteriorating components which reduce flow.

37. A method of controlling fuel flow along a fuel path comprising:

delivering fuel along a fuel delivery path;

providing a desired flow rate for regulating the rate of flow in the fuel delivery path during a fueling operation;

providing an actual flow rate;

deriving a forcing function according to a difference between the desired and actual flow rate;

modulating the flow of fuel in the fuel path according to the forcing function; and regulating the rate of flow in said fuel delivery path during a fueling operation to achieve a flow-rate-dependent result by increasing or decreasing the flow rate above or below the flow-rate-dependent result to compensate for any periods that varied from the flow-rate-dependent result.

* * * * *